United States Patent [19]

Catozzo

[11] 4,293,368

[45] Oct. 6, 1981

[54] FILM SPLICING DEVICES

[75] Inventor: Leo Catozzo, S. Severa, Italy

[73] Assignee: Costruzione Incollatrici Rapide C.I.R. S.r.L., S. Severa, Italy

[21] Appl. No.: 183,712

[22] Filed: Sep. 3, 1980

[30] Foreign Application Priority Data

Sep. 14, 1979 [IT] Italy ..... 50274 A/79

[51] Int. Cl.[3] ..... B31F 5/06; G03D 15/04

[52] U.S. Cl. ..... 156/506; 156/157; 156/304.3

[58] Field of Search ..... 156/157, 159, 304.3, 156/502, 505, 506

[56] References Cited

U.S. PATENT DOCUMENTS

| | | | |
|---|---|---|---|
| 3,075,572 | 1/1963 | Catozzo | 156/505 |
| 3,428,511 | 2/1969 | Catozzo | 156/505 |
| 3,450,589 | 6/1969 | Jorgensen | 156/505 |
| 3,709,759 | 1/1973 | Hyca | 156/506 |
| 3,717,535 | 2/1973 | Jorgensen | 156/506 |
| 4,002,522 | 1/1977 | Catozzo | 156/506 |

*Primary Examiner*—Michael G. Wityshyn
*Attorney, Agent, or Firm*—Browdy and Neimark

[57] ABSTRACT

A splicing device for film and magnetic tapes and the like includes a fixed and a movable bridge at both sides of a lower dieplate, over which bridges an adhesive tape is stretched correspondingly to the film splicing area on the dieplate. Oscillation of the movable bridge towards and away from its adjacent lower dieplate edge and the whole splicing operation of the film or tape are performed by a single manual movement of an operator of the splicing device.

3 Claims, 5 Drawing Figures

FIG.1
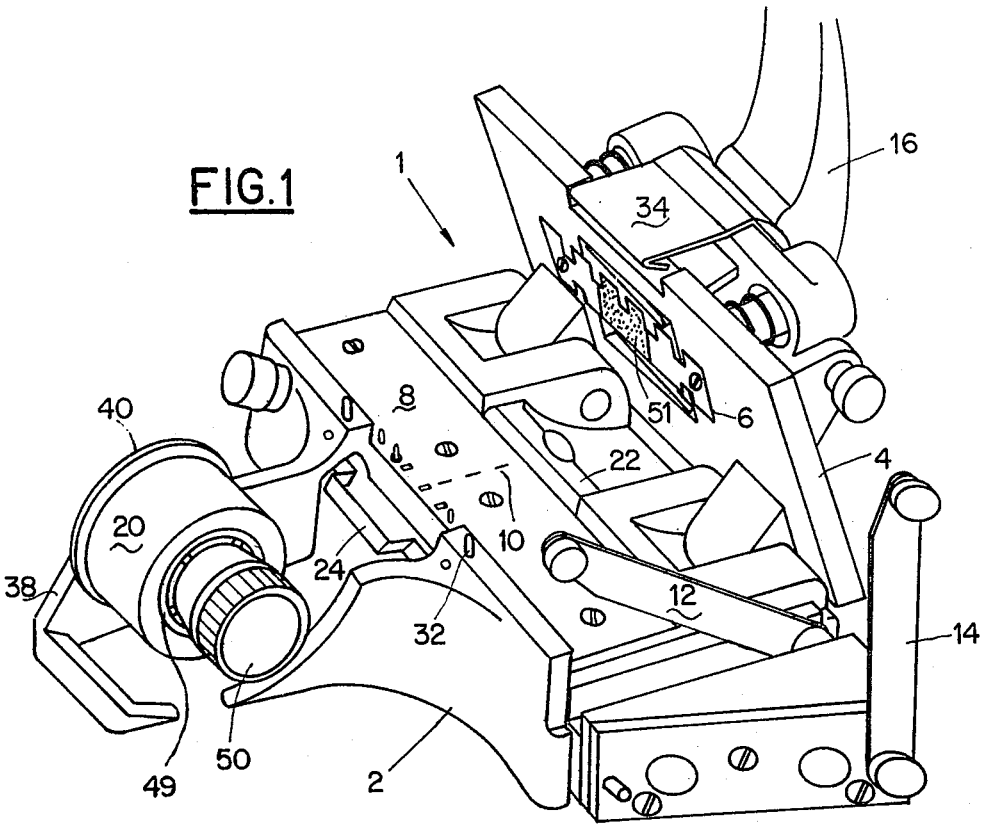
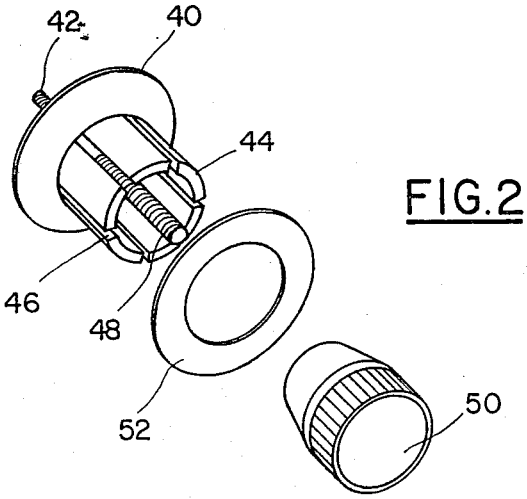
FIG.2

FILM SPLICING DEVICES

BACKGROUND OF THE INVENTION

The present invention relates to film splicing devices for splicing together, end to end, films, magnetic tapes and the like, the devices include a base containing a longitudinally extending lower dieplate and a lid, hinged to the base, comprising an upper dieplate and knives, coacting with edges of the lower dieplate, to trim an adhesive tape correspondingly to sides of the film. Correspondingly to said splicing area, both lateral edges of the lower dieplate are provided with bridges whose tops lie slightly above the lower dieplate. Over these two bridges is stretched an adhesive tape, without contacting the underlying film or tape ends to be spliced together, which tape is depressed upon them by lowering the upper dieplate upon the lower one, thereby connecting the film ends by the adhesive tape. As stated, cutting blades provided on the lid, when the latter is depressed upon the base, strip the adhesive tape in coincidence with the lateral edges of the lower dieplate.

Applicant's U.S. Pat. No. 4,002,522 discloses an improvement wherein at least one of the bridges is oscillatably mounted for movement between a position adjacent to the nearest lower dieplate edge and a position retracted therefrom, in which latter position the operator may readily insert his finger into the gap between the dieplate edge and the retracted bridge to grip one end of the adhesive tape adhering to the retracted bridge, detach it therefrom and stretch it until pressing it upon the top of the opposite bridge. In this operation, the adhesive tape adheres also to the oscillatable bridge and causes it to swing to its position adjacent to the corresponding lower dieplate edge. Spring means biasing the oscillatable bridge towards its retracted position cause the adhesive tape attached to both bridges to remain in tension. In this already disclosed device, the motion of the oscillatable bridge from its retracted position to its position adjacent to the corresponding lower dieplate edge has to be performed by hand.

SUMMARY OF THE INVENTION

It is the object of the present invention to integrate all the above-enumerated operations into a single one, controlled by the lifting and depressing of the lid upon the lower dieplate. This is achieved by a link mechanism operated by the lid. For this purpose the rotatory movement of the oscillating bridge towards the edge of the lower dieplate is brought about by the link mechanism by lowering the lid, with its upper dieplate, upon the lower dieplate, while also the movement of the movable bridge and the application of the adhesive tape upon it, is brought about by the lowering of the lid.

In order to ensure that the adhesive tape is always perfectly stretched between the two bridges, in order to prevent it from forming creases and wrinkles on the splice, the force necessary to unwind the tape from the taperoll mounted behind the movable bridge in the splicing device, must be adjustable to avoid a slack of adhesive tape between the two bridges. For this reason an adjustable brake means must be applied to the adhesive tape roll, in order to be able to adjust the force which must be exerted upon the adhesive tape to tension it from the taperoll up to the fixed bridge.

BRIEF DESCRIPTION OF THE DRAWINGS

An embodiment of the invention, applied to a splicing device for 16 mm cinematographic film, having only one perforated side, is now to be described, for a purely illustrative and not limitative purpose, with reference to the figures of the attached drawings, wherein:

FIG. 1 is a perspective view of a splicing device of a type which is per se known, to which the devices of the present invention have been applied;

FIG. 2 is an exploded view of the braking device of FIG. 1;

DESCRIPTION OF THE PREFERRED EMBODIMENT

Figure 3:
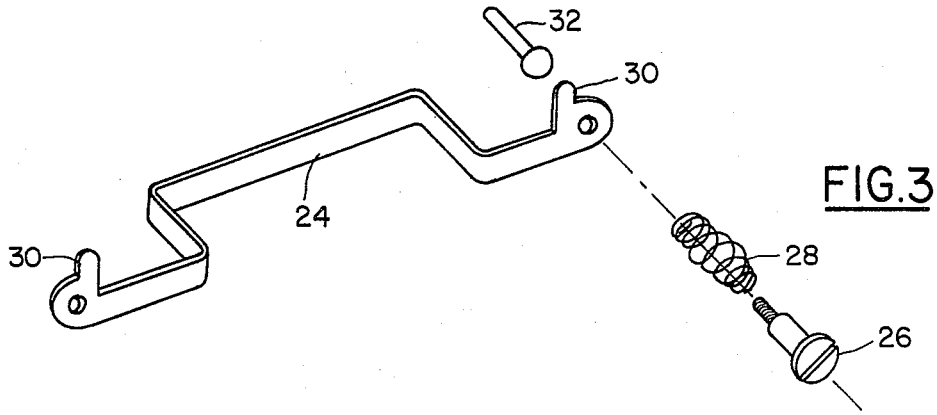
FIG. 3 is a perspective view of the movable bridge according to the invention.

With reference to the figures, there is generally indicated at 1 an exemplary splicing device in accordance with the present invention. It includes a base 2, upon which is hinged a lid 4 containing an extractor 6. Within a groove of the base is mounted a lower dieplate 8, whose width is in the present case 16 mm, and upon which are placed end to end the two film strips to be joined so that their ends meet correspondingly at a dotted line 10. A shearing knife 12 aids to cut the stretches of films to be joined at a right angle with the longitudinal axis of this film. A further shearing knife 14, forming an angle with the axis, aids to cut the magnetic film upon which the sound is recorded, since this shearing angle is necessary to eliminate any noise in the reading of the magnetic tape caused by the joint.

The lid 4 of the splicer is provided with two knives, which are not shown here, and which, with the lowering of the lid 4 and by pressing further upon a lever 16, trim the adhesive tape 18, unwound from an adhesive tape roll 20 up to the fixed rear bridge 22, in coincidence with the edges of the lower dieplate and therefore with the sides of the film or magnetic tape.

These components and the function of the splicer so far described are known per se and only mentioned for the purpose of easier understanding of the present invention.

Figure 4:
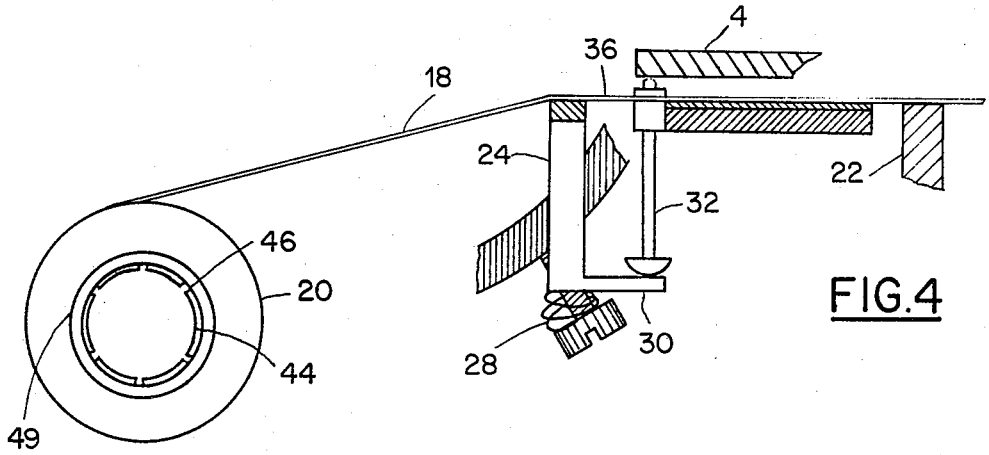
FIG. 4 shows the mechanism for the lowering of the movable bridge in a position approached to the edge of the lower dieplate.
Figure 5:
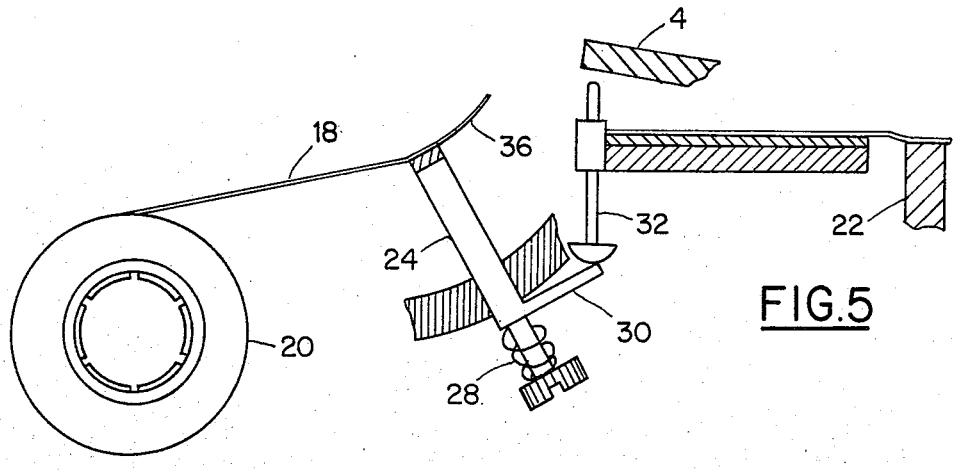
FIG. 5 shows this mechanism in the position retracted from said lower dieplate edge.

From the above-cited U.S. Pat. No. 4,002,522 it is also known to fix the movable bridge 24 to the base of the splicer by screws or bolts 26 passing through holes of the bridge and springs 28 interposed between the head of the screws or bolts and the bridge, as it clearly results from FIGS. 3, 4 and 5. This arrangement permits the bridge to move either along an oscillatory and a rectilinear motion relatively to the stem of the screws or bolts 26, as it will be better explained hereinafter. The movable bridge 24 differs however from that of the U.S. Pat. No. 4,002,522 for two tonguelets 30, one for each end of the movable bridge 24, each tongue 30 being resiliently biased on a pushing rod 32 sliding in the base 2 in the proximity of the fore or left edge of the base. In such a manner, when lowering the two bushing rods 32, the movable bridge is passed from the raised and inclined position, in which it is removed from the left edge of the lower dieplate (FIG. 5) to the vertical and lowered position shown in FIG. 4. The lever 16 (FIG. 1) hinged to the lid 4, is rigidly connected with two knives for the trimming of the adhesive tape and with punches apt to perforate the adhesive tape in the zone of the joint created between the two film ends. This construction is known per se, and therefore not illustrated in the figures. In this manner, after the lowering of the lid 4, a further lowering of the lever will cause the cutting of the adhesive tape correspondingly to the edges of the lower dieplate and the perforation of the adhesive tape correspondingly to the perforations of the film in the area of the joint. Also these particulars are known per se. According to the invention the lever 16 is however also integral with a tape pressing unit 34, so that simultaneously to the trimming and perforation of the adhesive tape, the latter is pressed and made to adhere upon the movable bridge 24. When thereafter the lever 16 and the lid 4 is lifted, the movable bridge will return, under the bias of the springs 28 in the position of FIG. 5, so that the operator may easily grip the projecting piece 36 of the adhesive tape and pull it as far as the rear or fixed bridged 22 and press it upon it, in order to render it ready for the formation of additional joints.

A tape depressor 51 ensures, when the lid is lowered, that the adhesive tape is firmly applied to the joint. However, in order to obtain that the stretch of adhesive tape interconnecting the two ends of the film or of the magnetic tape is perfectly smooth and free of creases or wrinkles which would disturb the passage of the joint through a movie projector, the adhesive tape 18 must oppose an adjustable resistance to its unwinding from tape roll 20. This renders therefore necessary an adjustable braking device which can adjust the resistance of the taperoll in order to regulate the force necessary for the rotation of said taperoll and which is applied to the wall portion 38 of the base 2 of the splicer. The device used in this embodiment of the invention comprises a disc 40, which may be screwed by a screw 42 to the base wall 38. On the opposite part of the taperoll, fins 44 are arranged circumferentially, which altogether define a hub which is perpendicular to the disc and coaxial with it and having at its center a further screw 48. The external diameter of the cylinder corresponds approximately to the internal diameter of the cardboard cylinder or core 49 upon which the adhesive tape roll is wound. The device is completed by a conical knob which can be screwed upon the screw 48. By screwing the knob 50 upon the screw 48 it is possible to adjust the expansion of the fins 44 and therefore the pressure of the cardboard cylinder 49 of the taperoll and therefore the resistance to rotation of said taperoll 20. The external diameter of the knob is slightly smaller than the internal diameter of the paper cylinder or core 49 of the taperoll, so that the core 49, once the taperoll 20 has been finished, may be easily extracted and replaced with a new taperoll without the need of completely unscrewing the knob 50. A washer or flange 52 may be inserted into the hub formed by the fins 44 and applied upon the disc 40 in order to be able to adjust, by its thickness, the centering of adhesive tapes of different width with respect to the centerline 10 of the lower dieplate.

What is claimed is:

1. An improved splicing device for connecting film, magnetic tape or the like, end to end with an adhesive tape (18) of the type having a base (2), a lower dieplate (8) fixed upon the base (2), a supporting wall (38) integral with said base (2) in order to rotatably sustain a roll (20) of said adhesive tape (18), an extractor (6) provided with a tape depressor (51) fastened upon a lid (4) hinged to said base (2), a lever (16) hinged in turn to said lid (4) and fitted with knives acting with the edges of said lower dieplate (8) in order to trim in coincidence with the edges of said lower dieplate (8) a piece of adhesive tape placed above film ends to be joined, and a movable bridge (24) on a fore edge of the lower dieplate (8) and a fixed bridge (22) on an opposite edge of said lower dieplate, the improvement which comprises means for moving said moveable bridge (24) from a retracted position removed from said fore edge of said lower dieplate (8) to a position close to said fore edge of said lower dieplate (8), said means including a pair of tonguelets (30) on each end of said moveable bridge (24), each said end being pressed by a respective spring (28) against a lower end of a respective pushing rod (32), which is slidable within said base (2), an upper end of each said rod projecting beyond said base (2), whereby lowering of said lid (4) upon said base, by lowering said rods (32), causes a rotatory movement of said bridge towards said fore edge of the lower dieplate (8) and lifting of the lid (4), after the shearing of adhesive tape (18) causes, under the action of the springs (28), the rotation of the movable bridge (24) away from the edge of said lower dieplate (8), thereby permitting an operator to easily grip an end (36) of adhesive tape (18) projecting from the moveable bridge (24) in order to pull it and press it against the fixed bridge (22) for any further production of a joint between other film or tape ends.

2. An improved splicing device according to claim 1, further comprising a tape depressing unit (34) integrally fastened onto the lever (16), whereby, with the lid (4) lowered and the moveable bridge (24) in a position close to the edge of the lower dieplate (8), a length of adhesive tape stretched between a taperoll (20) and the fixed bridge (22) is pressed against an upper portion of said moveable bridge (24) and remains adherent thereto.

3. The splicing device according to claim 1, further comprising a braking device, which aids in adjusting the force necessary for the rotation of the roll (20) upon its support, said braking device including a disc (40) which can be fastened by a screw (42) to the supporting wall (38), fins (44) forming together a hub coaxial to said disc (40) and separated from each other by slits (46), a further screw (48) coaxial and interior to said hub, a knob (50) of conical form, which can be screwed upon said further screw (48) in order to spread said fins (44) apart by screwing said knob toward the interior of the cylinder, in order to increase the pressure of said fins against a cardboard cylinder forming a core (49) upon which the adhesive tape (18) is wound, whereby the friction between the fins and said core (49) is adjusted together with the force necessary to unwind the adhesvie tape (18) from the taperoll (20).

* * * * *